United States Patent [19]

Balmer et al.

[11] Patent Number: 4,610,271

[45] Date of Patent: Sep. 9, 1986

[54] HIGH PRESSURE HYDRAULIC DISTRIBUTOR

[75] Inventors: Clifford J. Balmer, St Germain-en-Laye; Richard Goddard, Senlis, both of France

[73] Assignee: Vickers Systems S.A., Saint Quen l'Aumone, France

[21] Appl. No.: 763,809

[22] Filed: Aug. 8, 1985

[30] Foreign Application Priority Data

Aug. 31, 1984 [FR] France ..... 84 13505

[51] Int. Cl.[4] ..... F15B 13/02

[52] U.S. Cl. ..... 137/596.13; 60/427; 60/431; 137/625.68

[58] Field of Search ..... 66/427, 431; 137/596.13, 625.68

[56] References Cited

U.S. PATENT DOCUMENTS 3,470,694 10/1969 Budzich ..... 60/427

*Primary Examiner*—Gerald A. Michalsky

*Attorney, Agent, or Firm*—Fiddler & Levine

[57] ABSTRACT

A high pressure hydraulic distributor with a pilot pressure generator, in which a device for reducing pressure is integrated into a distribution section of a compound high pressure hydraulic distributor. The displacement of the slide of the distributor of the section concerned modifies automatically the calibration of the pressure reducer and permits obtaining a reduced pressure which is a function of the displacement of the slide. This reduced pressure is utilized as the pilot pressure for the control means of the source of hydraulic fluid pressure which feeds the distributor.

15 Claims, 10 Drawing Figures

HIGH PRESSURE HYDRAULIC DISTRIBUTOR

The present invention relates to a high pressure hydraulic distributor.

More precisely, it relates to a hydraulic distributor of the type comprising at least one inlet duct able to be connected to a source of hydraulic fluid under high pressure, at least one principal outlet duct able to be connected to means for utilising hydraulic fluid under high pressure, at least one return duct able to be connected to a reservoir of hydraulic fluid under low pressure, and distributor means able to occupy several conditions in which it establishes or interrupts hydraulic connections between certain of these said ducts, and in particular at least one passive condition in which the distributor means establishes a hydraulic connection between the inlet duct and the return duct interrupting any hydraulic connection between the inlet duct and the principal outlet duct, and at least one active condition in which the distributor means establishes a hydraulic connection between the inlet duct and the principal outlet duct interrupting any hydraulic connection between the inlet duct and the return duct.

Such hydraulic distributors are very often used as control systems for motors with different functions on mobile machines, and by "high pressures" is intended in a general sense pressures of a high order which are in question for example when the utilisation means are constituted by hydraulic jacks carrying out the functions of handling loads or displacing members on mechanical handling mobile machines or on agricultural machines, and by "low pressures" is intended pressures of a substantially lower order, and for example of the order of atmospheric pressure.

In such applications, several hydraulic distributors are generally juxtaposed in a compound central distributor, of which each of them constitutes a section, having a determined function.

In such applications, there is very often a requirement to be able to control in an independent manner the hydraulic fluid flow rates at high pressure feeding the different sections; for example, in the case of a lift truck, of which one distributor section controls the load lifting jack and other sections, respectively, a mast inclination jack, a mast advance jack, a fork separation jack, these being non-limitative examples, the section controlling the lifting of the load requires a comparatively large flow rate, because of the large cylinder of the lifting jack, whilst the other sections require comparatively small flow rates.

The ratio of the different requirements, in terms of flow rates, according to which of one function or another is used by an appropriate activation of the respectively corresponding distribution section, is difficult to reconcile with the feed of the distributor from a single source of hydraulic fluid, in practice a pump driven by a motor of the machine and drawing from a hydraulic fluid reservoir, the different distribution sections at will either feeding towards the members carrying out the functions to which these sections are respectively connected, or returning towards the reservoir; in the state of the art, furnishing is ensured of a sufficient flow rate for carrying out all the functions, possibly simultaneously, making the pump work permanently at its maximum flow rate, which leads to direct recycling to the reservoir, practically all the time, a flow which can be large; in other words, this leads to a waste of energy since the longer the pump provides a high flow, the more energy it consumes.

Now, any excess consumption of energy is to be condemned, particularly in the case of self-contained mobile machines, that is to say having their own source of energy such as for example a battery of accumulators, insofar as any waste of energy leads in this instance to a reduction of self-containment.

For remedying this inconvenience, it has been envisaged to feed each distribution section by its own source of hydraulic fluid, furnishing a flow rate adapted to the needs of the member associated with this section; such feed from several sources is costly of materials.

The object of the present invention is to permit use of a single source of hydraulic fluid for feeding a compound distributor, without bringing about a waste of energy.

For this, the present invention proposes a hydraulic distributor which is able to constitute one of the portions of distribution of a compound distributor, and which permits piloting constantly the condition of the pump, so that its flow rate is constantly adapted to the needs, that is to say to limit constantly as necessary the consumption of the motor driving the pump; naturally, since the compound distributor emits a pilot signal representative of the flow needs, this signal can equally be used for other ends and for example for powering means for displaying these needs.

In a hydraulic distributor according to the present invention, of the type comprising at least one inlet duct able to be connected to a source of hydraulic fluid under high pressure, at least one principal outlet duct able to be connected to means for utilising hydraulic fluid under high pressure, at least one return duct able to be connected to a reservoir of hydraulic fluid under low pressure, and distributor means able to occupy several conditions in which it establishes or interrupts hydraulic connections between certain of these said ducts, and in particular at least one passive condition in which the distributor means establishes a hydraulic connection between the inlet duct and the return duct interrupting any hydraulic connection between the inlet duct and the principal outlet duct, and at least one active condition in which the distributor means establishes a hydraulic connection between the inlet duct and the principal outlet duct interrupting any hydraulic connection between the inlet duct and the return duct, is characterised in that it comprises in addition:

an auxiliary outlet duct, pressure reducing means, sensitive to the hydraulic pressure in the inlet duct, for establishing a hydraulic connection between the inlet duct and the auxiliary outlet duct:

when the value of hydraulic pressure in the inlet duct passes a predetermined threshold, and then causes the appearance, in the auxiliary outlet duct, of a hydraulic pilot pressure of a reduced value with respect to the value of the hydraulic pressure in the inlet duct, when the value of the hydraulic pressure in the inlet duct is below the said threshold, and to transmit this pressure to the auxiliary outlet, the said threshold being on the one hand greater than the maximum value of hydraulic pressure in the inlet duct when the distributor means occupies the said passive condition and the inlet duct and the return duct are respectively connected to the source and to the reservoir, and on the other hand lower than a minimum value of hydraulic pressure in the inlet duct when the distributor means occupies the said active condition and the inlet duct and the principal outlet duct are respectively connected to the source and to the utilisation means, modulation means, coupled to the distributor means, for modulating the value of the piloting hydraulic pressure in a predetermined manner, as a function of the condition of the distributor means.

In an embodiment of the invention, the modulation means are such as to attribute to the piloting hydraulic pressure a first predetermined value when the distributor means occupies the passive condition, and at least a second predetermined value, different from the first and for example greater than it, when the distributor means occupies the active condition.

For example, for this, the pressure reducing means and the modulation means coupled to the distributor means can advantageously be constituted so that the distributor comprises:

a bore having an internal peripheral surface defining a longitudinal direction, a first transverse end, a second transverse end, means for hydraulic connection of the said first end with the auxiliary outlet duct, means for hydraulic connection of the second end with the return duct, at least two orifices arranged in the said internal peripheral surface, with a first orifice comparatively close to the said first end and a second orifice comparatively further from the said first end, a piston mounted for longitudinal sliding inside the bore and having an external peripheral surface in sliding and fluid-tight contact with the internal peripheral surface of the bore, a face of the first transverse end opposite the first end of the bore, and a second transverse end opposite the second end of the bore, a compression spring acting between the said second ends for resiliently urging the piston, in the bore, towards the first end of the latter, a passage arranged, arranged in the piston, opening on the one hand in the face of the first transverse end of the piston and on the other hand in the external peripheral surface of the piston, opposite the said orifices of the internal peripheral surface of the bore, auxiliary distributor means, coupled to the principal distributor means, for establishing a hydraulic connection between the said inlet duct and, alternatively, the first orifice or the second orifice according, respectively, to the distributor means cited above occupying the passive condition or the active condition.

Advantageously, the auxiliary distributor means and the distributor means first cited can be constituted by the same slide, in which the said bore can advantageously be situated, which leads to a particularly simple and compact structure.

In accordance with a particularly advantageous embodiment of the invention, when the distributor means is able to occupy a plurality of active conditions in which they establish a hydraulic connection between the inlet duct and the principal outlet duct permitting respectively different flow rates from the inlet duct to the principal outlet duct, and interrupting any hydraulic connection between the inlet duct and the return duct, the modulation means are so provided that they themselves attribute to the hydraulic pilot pressure a first predetermined value when the distributor means occupies the passive condition, and a plurality of second predetermined values respectively, different from the first and different from each other, when the distributor means occupies the different active conditions; then, advantageously, the said second values are greater than the first value, increasing or decreasing, respectively, when the flow rate permitted by the distributor means increases or decreases; in a particularly simple manner, the means for calibration can attribute the said second values in steps, even when the different active conditions are accessible in continuous succession, permitting varying of the flow rate in a continuous manner.

In the case of a practical embodiment of the pressure reducing means and of the modulation means mentioned above, this result can advantageously be obtained in that the internal peripheral surface of the bore has a plurality of second orifices differently spaced from the first end of the bore, and in that the auxiliary distributor means coupled to the principal distributor means is able to establish a hydraulic connection between the inlet duct and, selectively, a respective one of the said second orifices when the principal distributor means occupies the said active conditions, the said respective second orifice being itself further from the first end of the bore so that the active condition occupied by the distributor means corresponds to a greater permitted flow.

It should be noted that, in the case where the hydraulic pilot signal is used for piloting the condition of the pump consitituting the source of hydraulic fluid, the variation by steps of the value of this pilot signal leads to a variation also by steps in the condition of the pump, that is to say not by a strict adaptation of the flow rate of this and of the consumption of its drive motor of energy to the real flow needs, but to an approximation, necessarily in excess; nevertheless, such an approximation constitutes an excellent compromise taking account of the great simplicity of the practical embodiment which is accomplished.

Advantageously, the hydraulic distributor according to the invention can comprise safety means, for: automatically establishing a connection between the auxiliary outlet duct and the return duct if the value of hydraulic pressure in the auxiliary outlet duct passes a predetermined threshold greater than the said values of the pilot pressure, automatically interrupting any connection between the auxiliary outlet duct and the return duct if the value of hydraulic pressure in the auxiliary outlet duct is lower than this other predetermined threshold.

For this, advantageously, in the case of the practical embodiment of the pressure reduction means and modulation means mentioned above, these security means can be constituted by means for establishing automatically a hydraulic connection between the passage of the piston and the second end of the bore if the hydraulic pressure to the first end of the bore passes a predetermined threshold, or for automatically interrupting any hydraulic connection between the passage of the piston and the second end of the bore if the hydraulic pressure at the first end of the bore is lower than this predetermined threshold.

Thus, the possible appearance of a counter-pressure in the auxiliary outlet duct, able to occur for example when the pilot pressure is utilised for controlling a jack for adjusting the condition of a combustion drive motor for the source of hydraulic fluid, cannot lead to damaging of the distributor insofar as the possible counter-pressure is automatically evacuated towards the reservoir since it passes a predetermined threshold.

Other characteristics and advantages of the present invention will appear from the following description, of a non-limitative embodiment of the invention, as well as from the accompanying drawings which form an integral part of this description.

Figure 1:
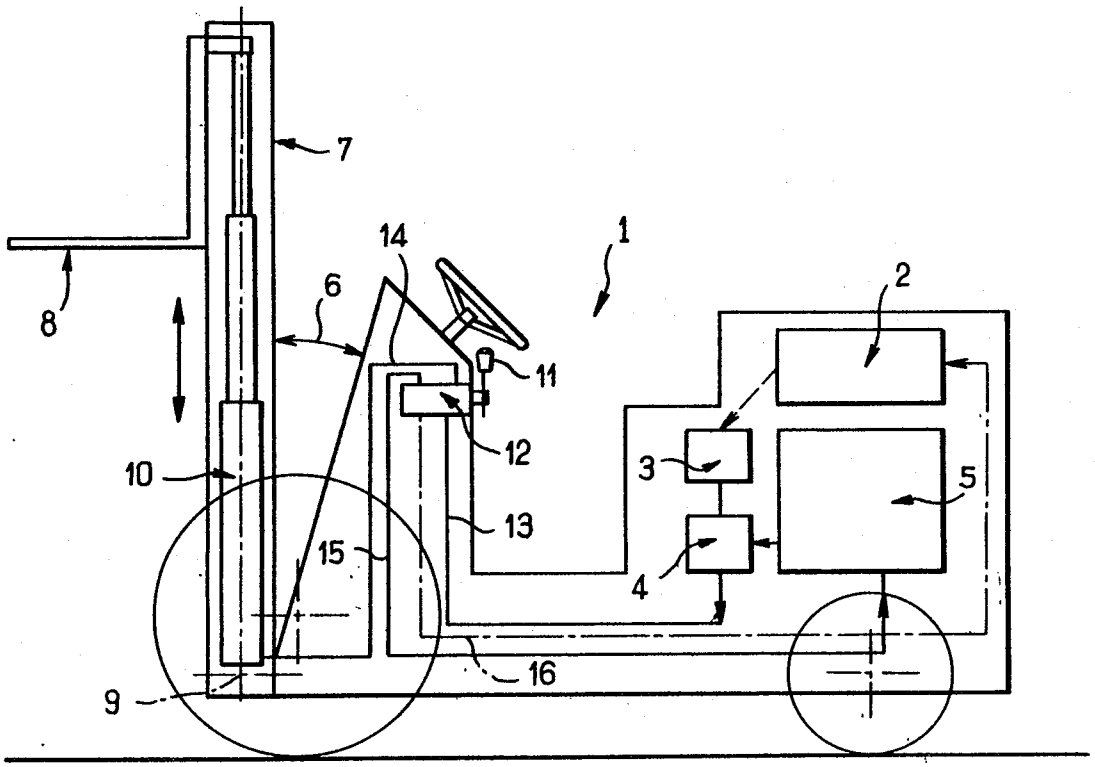
FIG. 1 shows, by way of example of a machine putting the present invention into operation in a particularly advantageous manner, a fork-lift truck, with a thermo-dynamic propulsion motor, of which are shown only the parts necessary for comprehending the description which follows.

In FIG. 1, is shown a fork-lift truck 1 having a thermodynamic drive motor 3 for a pump 4 of which the function is to pump hydraulic fluid in a reservoir 5 at low pressure, with a flow rate controlled by the condition of the motor 3 itself controlled by a hydraulic servo-motor 2, for feeding such a fluid under high pressure to a certain number of jacks, and for example a double acting jack not shown intended to cause at will a tilting movement 6 of a mast 7 carrying the fork 8, about a horizontal axis 9 connected to the truck 1, and a single acting jack 10 intended to act positively on the fork 8 in the lifting direction along the length of the mast 7, and to allow passive redescent of the fork 8 along the length of the mast 7, at will of an operator by action on a control lever 11 of a distributor 12 according to the invention.

This distributor, which will be described with reference to FIGS. 2 to 9, has for this means for connection with a duct 13 connecting to a pump 4, for receiving from the latter hydraulic fluid under pressure when it is in service, with a principal outlet duct 14 assuring connection of this distributor with the chamber (not shown) of a jack 10 for introducing hydraulic fluid into this and rendering this jack active, with a return duct 15 connecting the distributor 12 to a reservoir 5 for ensuring, together with the duct 14, the return of fluid towards this reservoir 5 when the jack 10 functions in the passive condition, and, in accordance with the present invention, with an auxiliary outlet duct 16 for transmitting to the hydraulic servo-motor 2 a pilot pressure for the condition of the motor 3, that is to say the flow rate of the pump 4.

Figure 2:
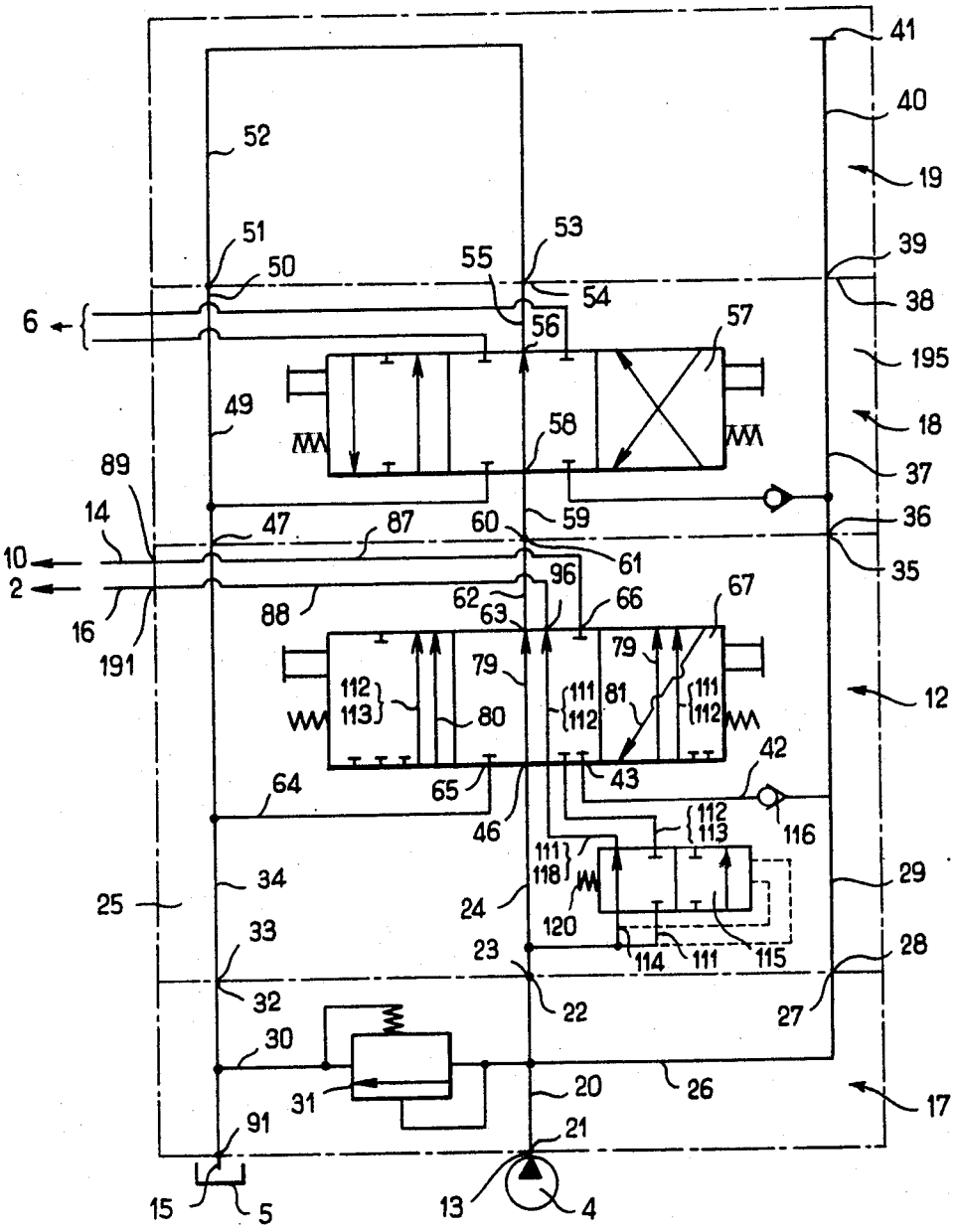
FIG. 2 shows a diagram of the integration of a distributor according to the invention as a first distribution section, into a central integrated compound distributor of the hydraulic circuit of the truck illustrated in FIG. 1, the distributor being in the neutral position, corresponding to a passive condition with reference to the definition of such position which has been given above.

In FIG. 2, the integrated distributor 12 is schematically shown as the first distribution section in a bank of distributors, or central compound distributor, fed in parallel.

On this FIG. 2 will be found the ducts 13,14,15,16, as well as the pump 4, the reservoir 5, the single acting jack 10, and the hydraulic servo-motor 2.

The bank of distributors illustrated in FIG. 2 has an inlet section 17, to which is directly juxtaposed the first distribution section defined by the distributor 12, to which is juxtaposed in its turn a second distribution section constituted by a distributor 18 of a traditional type intended for example to feed the double acting jack (not shown) for tilting 6 of the mast 7, to section 18 being juxtaposed an end section 19; naturally, the distributor constituting the second section 18 can be different from that which is illustrated, and several distribution sections can be interposed in place of the second section 18 between the first section 12 and the end section 19; this latter can also be directly juxtaposed to the first section 12.

The inlet section 17 defines a first hydraulic fluid feed duct 20, which has a first end 21 having connection means to the duct 13 and a second end 22 having connection means with a first end 23 of a first inlet duct 24 of the body 25 of the distributor 12; between the ends 21 and 22 of the duct for fluid 20 branch from the latter, inside the inlet section 17, on the one hand a second duct for feeding fluid 26, having in addition an end 27 provided with means for connection to an end 28 of a second inlet duct 29 arranged in the body 25 of the distributor 12, and on the other hand a return duct 30 towards the reservoir 15, which duct 30 has inside an inlet block 17 a pressure limiter 31 and is branched in a manner to have in addition two ends, with an end 91 having connection means to the duct 15 and with an end 32 provided with connection means to an end 33 of a return duct 34 arranged in the body 25 of the distributor 12; in a manner known in itself, the ducts 24,29,34 are connected, by their respective ends 23,38,33, to the ends 22,27,32 of ducts 20,26,30 of the inlet section 17 by the fact of a simple juxtaposition of the body 25 of the distributor 12 to the inlet section 17 on assembly, the connection means being constituted by the means for assembling the body 25 and the inlet section 17 and by fluid-tight joints about the different ducts already connected between them; analogous means are utilised for ensuring all the connections to a duct of one section to a duct of another section which will be described below.

The duct 29 crosses the body 25 of the distributor 12 from one side to the other, for presenting a second end 35 provided with connection means to an end 36 of an analogous duct 37 of a body 195 of the distributor constituting the section 18, this duct 37 is continued itself across the body of the distributor as far as an end 38 provided with connection means to an end 39 of a duct 40 arranged in the end section 19, in which this duct 40 has a closed end 41.

Between the ends 28 and 35 of the duct 29 branches from it, inside the body 25 of the distributor 12, a duct 42 opening, by an end 43, into a bore 44 crossing the body 25 from side to side, following a rectilinear axis 45 defining a longitudinal direction and perpendicular to the direction following which the duct 29 crosses the body 25 (see FIGS. 3 to 9 as concerns the references 44 and 45, which do not appear on FIG. 2); between its connection with the duct 29 and its end 43, the duct 42 has a non-return valve 116 permitting passage of fluid from the duct 29 towards the end 43 and preventing passage of fluid from the end 43 towards the duct 29.

The duct 24 has itself a second end 46 by which it also opens into the bore 44, in the form of an annular groove about the axis 45 as the end 43 of the duct 42.

The duct 34 itself crosses the body 25 from side to side, as does the duct 29, for presenting a second end 47 provided with connection means to a first end 48 of a duct 49 of the body 195 of the distributor constituting the second section 18, this duct 49 continuing across this body 195 as far as a second end 150 to which it presents connection means with a first end 51 of a duct 52 arranged in the end section 19, this duct 52 opening in addition outside this section 19 by a second end 53 provided with connection means to a first end 54 of a duct 55 which is arranged in the body 195 of the distributor constituting the second section 18 and which presents in addition inside this body 195 a second end 56 which the slide 57 of the distributor constituting the second section 18 permits to connect to an end 58 of the other duct 59 of the body of this distributor, which duct 59 presents another end 60 provided with connection means to a first end 61 of a duct 62 of the body 25 of the distributor 12; this duct 62 presents in addition a second end 63 by which it opens into the bore 44, in the form of an annular groove about the axis 45.

In addition, from the duct 34 branches, inside the body 25, a duct 64 opening via an end 65, in the form of an annular groove about the axis 45, into the bore 44.

In fact, in the body 25 are hollowed two other ducts 87,88 of which the first opens on the one hand into the bore 44 via a groove 66, annular about the axis 45, and on the other hand outside the body 25 via a end 89 provided with connection means 90 to a duct 14 in connection with the jack 10, and of which the second end opens on the one hand into the bore 44 via a groove 96 annular about the axis 45, and on the other hand outside the body via an end 191 provided with means 92 for connection to an auxiliary outlet duct 16; the connection means 90 and 92 are for example constituted by a threading inside the ducts 87 and 88 at their ends 89 and 191, respectively.

Referring to FIGS. 3 to 9, it will be seen that duct 34, cutting the bore 44, and the grooves 96,46,63,43,66,65, annular about the axis 45, succeed each other in this order from left to right along the axis 45; the intersection of the duct 34 with the bore 44 and the different grooves 96,46,63,43,66,65 being in the form of enlargements, transversely with respect to the axis 45, of the bore 44 itself a cylinder of revolution about this axis 45 with a constant diameter D, for defining from one side to the other of the intersection of the bore 44 with the duct 34 and from one side to the other of each of the mentioned grooves narrowings, with which a slide 67, slidingly mounted on the axis 45 in the bore 44, permits establishment of fluid-tight contact.

The slide 67 crosses the body 12 from end to end on an axis 45, via the bore 44, and presents respectively from side to side of the body 12 an end 68 for articulation on the control lever 11 about an axis 71 perpendicular to the axis 45 and parallel to an axis 72 of articulation of the lever 11 on the body 25, and an end 69 for functional connection with a return spring 70.

Figure 3:
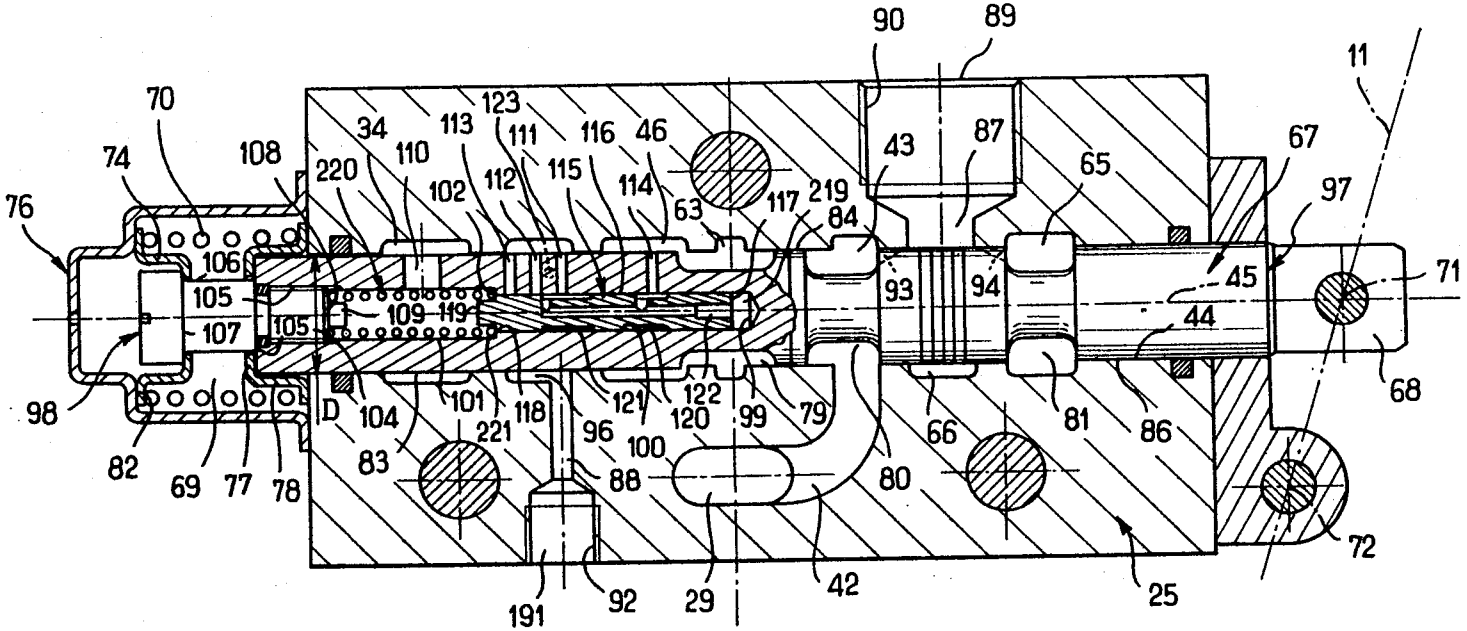
FIG. 3 shows a cross-section of a distributor according to the invention in such a neutral position.
Figure 4:
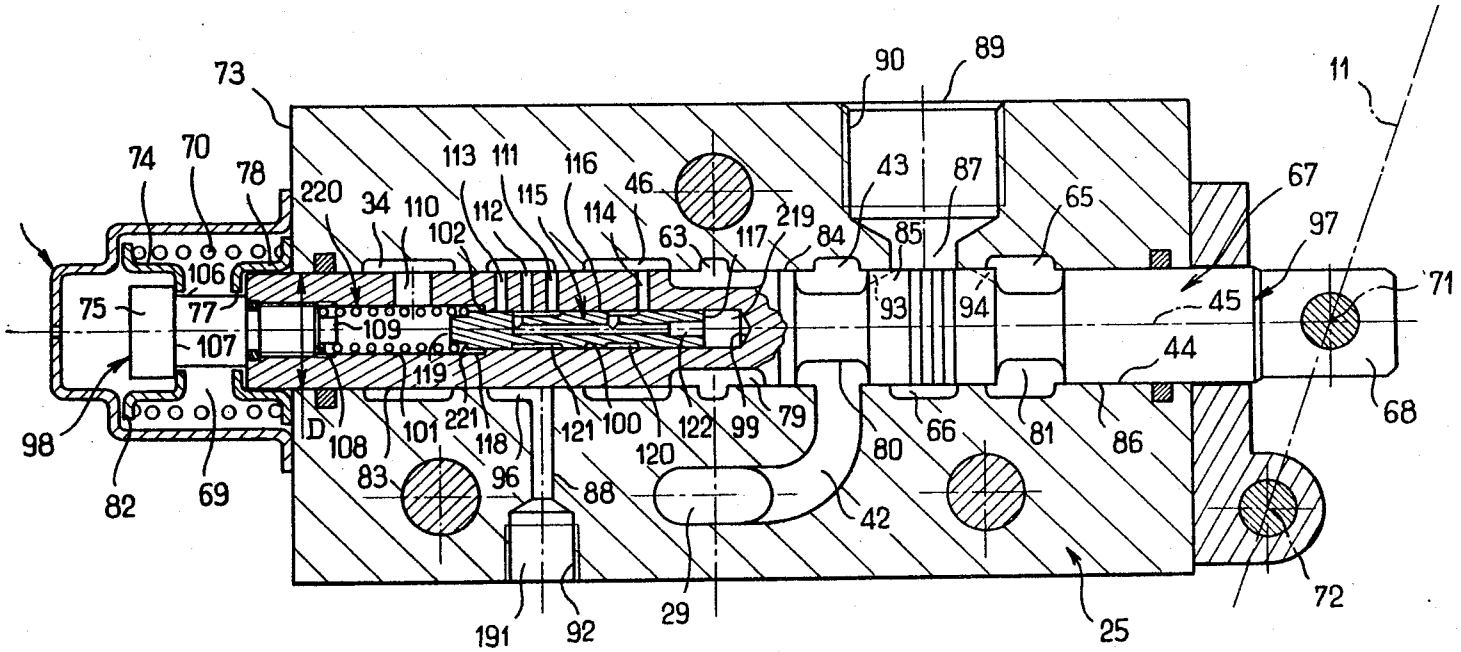
FIG. 4 shows a cross-section of this distributor in an intermediary position between the neutral position and a position corresponding to the active condition as described above.
Figure 5:
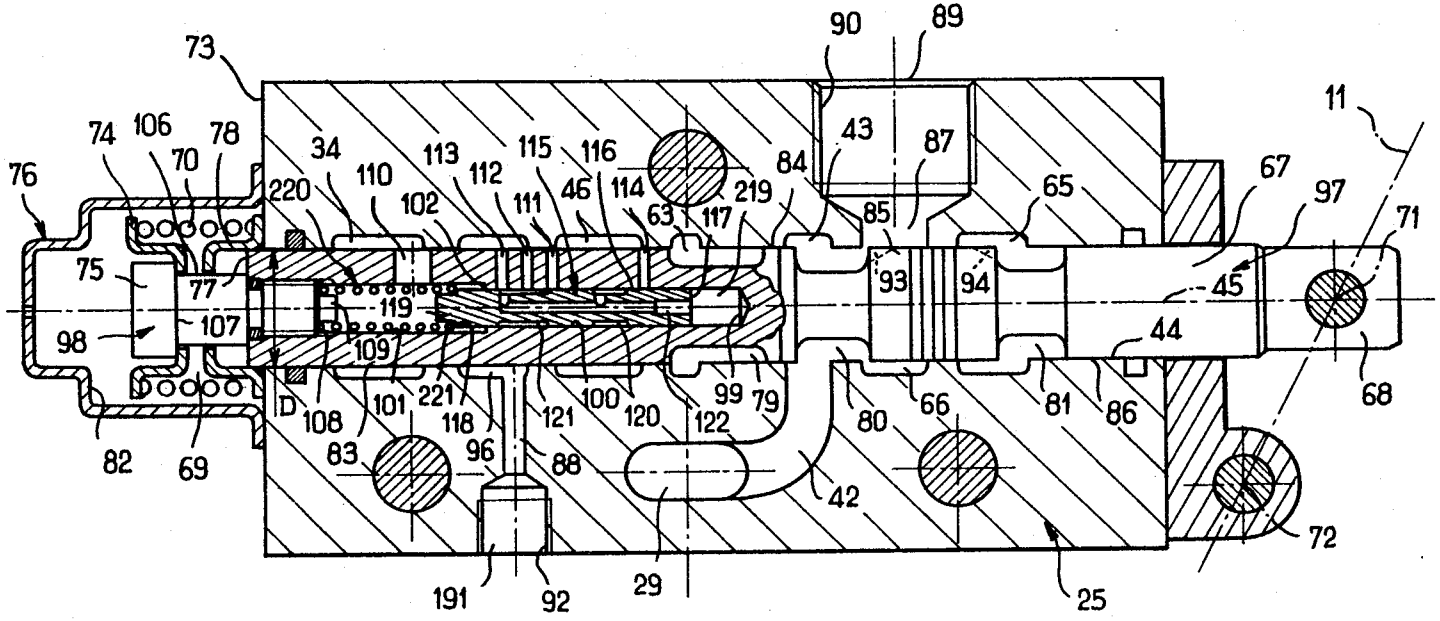
FIGS. 5 and 6 show cross-sections of the distributor in two active conditions, corresponding to the permitted flow rates, from the inlet duct towards the principal outlet duct, of respective mean and maximum values.
Figure 6:
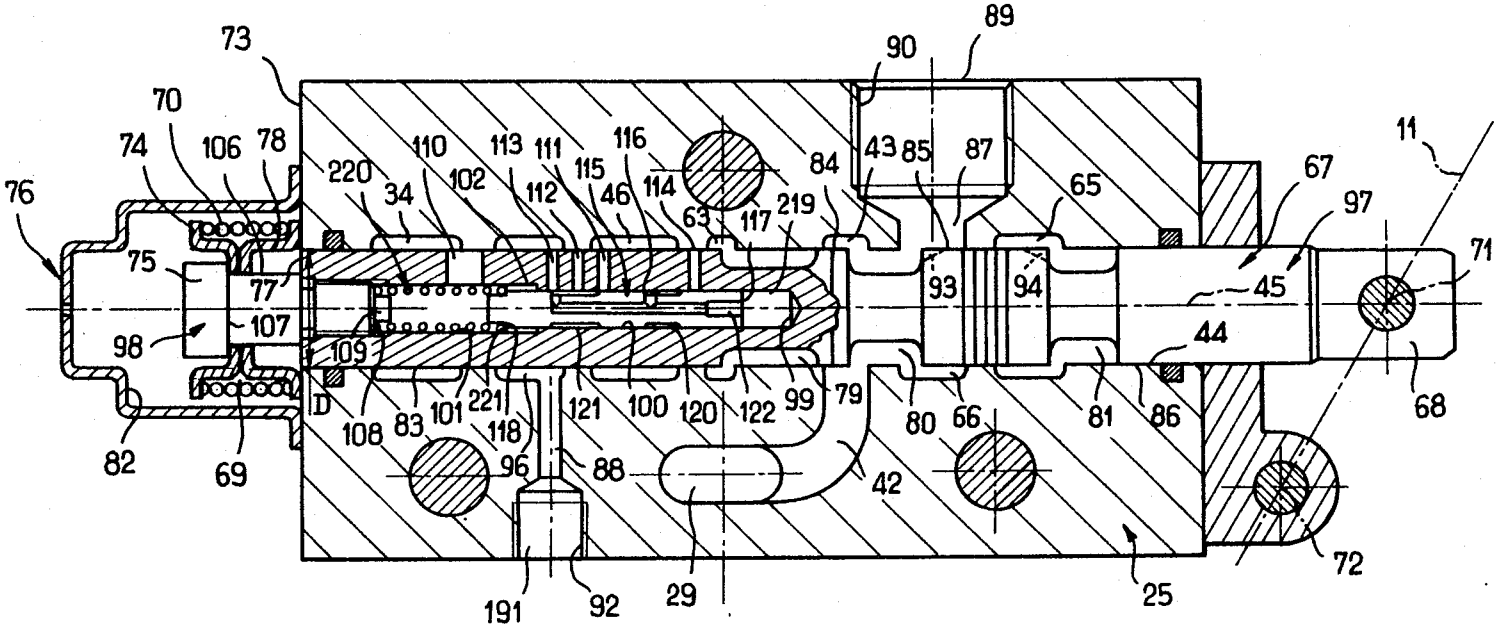
Figure 7:
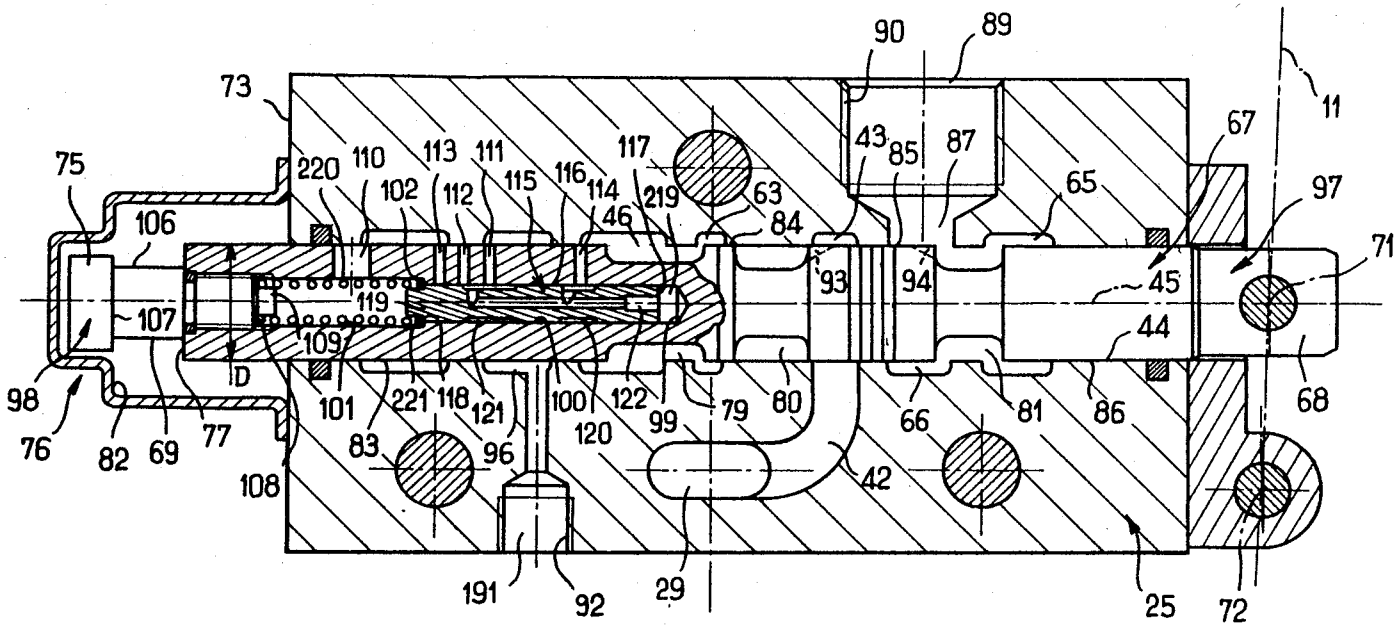
FIG. 7 shows a cross-section of the distributor in a passive condition different from that which is illustrated in FIG. 3.
Figure 8:
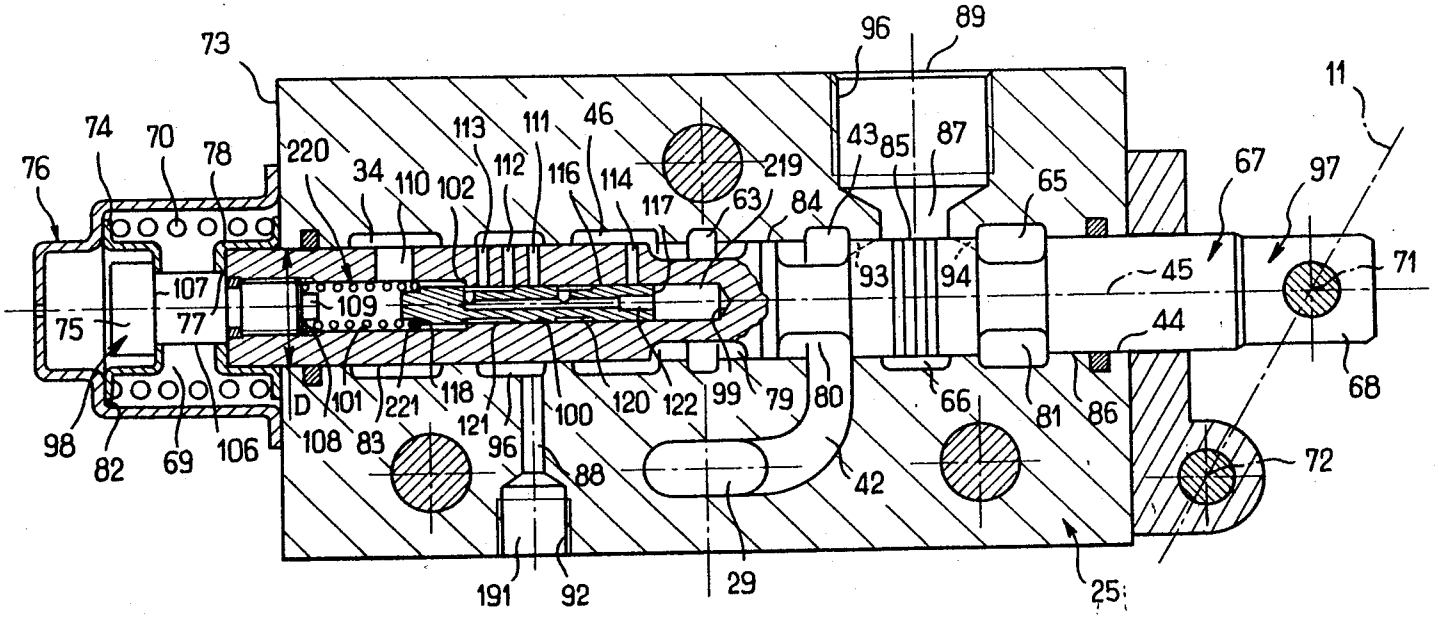
FIG. 8 shows a cross-section of the distributor in a neutral position, when an excessive counter-pressure appears in the auxiliary outlet duct.
Figure 9:
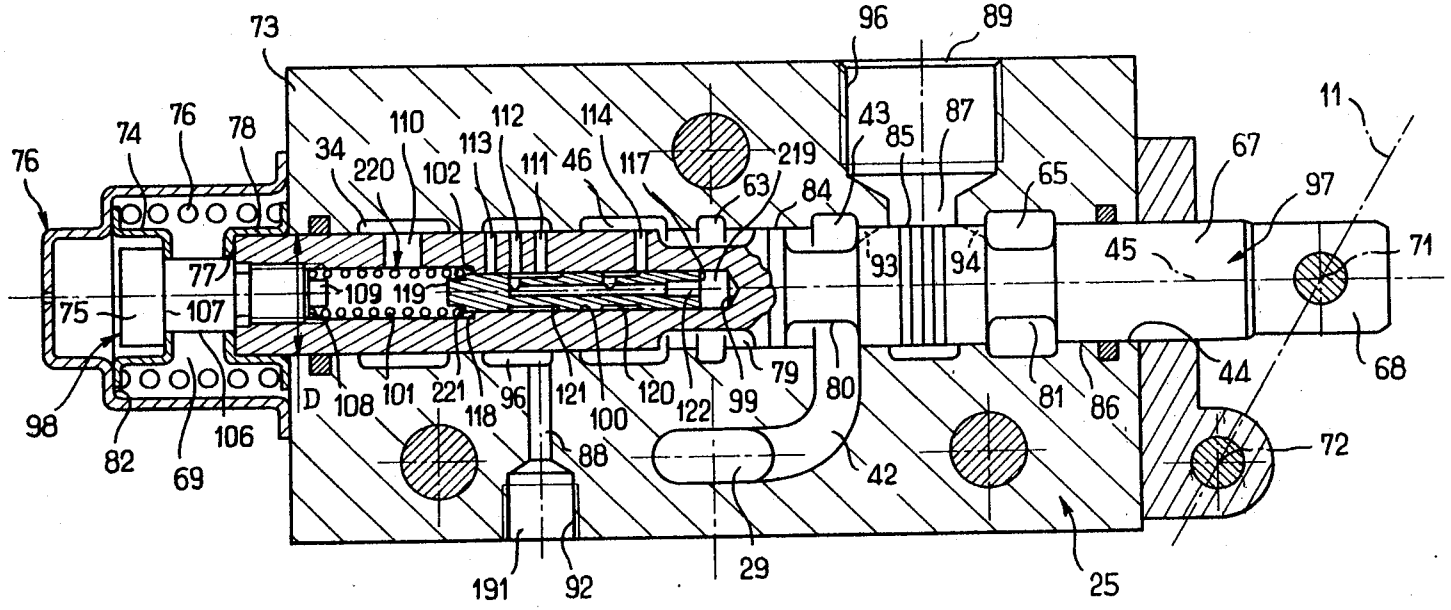
FIG. 9 shows a cross-section of the distributor in a neutral position, as well as a distributor of another distribution section in the active condition such as described above a propos of the distributor according to the invention.

In the illustrated example, where the end 68 for articulation on the lever 11 as well as this latter are situated to the right of the body 25 then the end 69 is situated to the left of this, the spring 70 is positioned to the left of an end face 73 of the body 25 and is in the form of a spring helicoidal about the axis 45, working in compression between two cupped washers 74 and 78, both on the axis 45 and mounted for sliding parallel to this axis, on the slide 67, between an end head 75 of this slide 67 and a shoulder 77 which this latter presents towards the end head 75; the cupped washer 78, situated to the right of the cupped washer 74 in FIGS. 3 to 9, presents also a radially interior peripheral zone, with reference to the axis 45, directly opposite the shoulder 77, turned towards the left and towards the head 75, and a radially exterior zone placed directly opposite the end face 73 of the body 25 of the distributor 12, and more precisely opposite a plane zone of this face 73, perpendicular to the axis 45, around the bore 44 at its intersection with the face 73; the cupped washer 74 itself presents also a radially internal peripheral zone, with reference to the axis 45, interposed between the inner peripheral zone of the cupped washer 77 and the head 75, and a radially exterior peripheral zone, with reference to the axis 45, interposed between the outer peripheral zone of the cupped washer 78 and an abutment face 82, plane, and annular about the axis 45, which a cover 76 carried in a fixed manner by the face 73 of the body 12 for closing the bore 44 at its end corresponding to this face 73 presents towards the latter; the sides of the cupped washer 74 and 78 particularly parallel to the axis 45, the distance separating the head 75 of the shoulder 77 parallel to this axis, and the distance separating the abutment face 82 of the cover 76 of the zone of the face 73 around the opening of the bore 44 in this latter, parallel to the axis 45, are chosen such that, when the slide 67 occupies a neutral position illustrated in FIG. 3 and which will be described below, the cupped washers 74 and 78 are respectively in contact with the face 82 of the cover 76 and with the face 73 by their external peripheral zones, and respectively in contact with the end head 75 and with the shoulder 77 by their inner peripheral zones, the spring 70 being in compression, so that this neutral position illustrated in FIG. 3 constitutes a stable position towards which the slide 67 tends to return automatically in case of displacement from this position, by sliding inside the bore 44 following the axis 45; the dimensions mentioned above are in addition such that, from this neutral position and acting on the lever 11, one can displace the slide 67 slidingly following the axis 45 inside the bore 44, in one direction or the other, that is to say either towards the right as far as the inner peripheral zone of the cupped washer 74, in abutment to the left against the end head 75 of the slide 67, comes in abutment to the left against the inner peripheral zone of the cupped washer 78 itself in abutment to the right against the face 73 via its outer peripheral zone, the respective contacts between the inner peripheral zone of the cupped washer 78 and the shoulder 77 of the slide 67 and between the outer peripheral zone of the cupped washer 74 and the face 82 of the cover 76 being then broken, or towards the left as far as a limit position in which the inner peripheral zone of the cupped washer 78, in abutment to the right against the shoulder 77 of the slide 67, comes into abutment to the left against the inner peripheral zone of the cupped washer 74 itself in abutment, via its outer peripheral zone, against the annular face 82 of the cover 76, the contact between the inner peripheral zone of the cupped washer 74 and the head of the end 75 and the contact between the outer peripheral zone of the cupped washer 78 and the face 73 being then interrupted; whether this displacement from the neutral position is accomplished towards the right or towards the left, it is accompanied by a supplementary compression of the spring 70, which, as has been mentioned above, tends to return the slide 67 to the neutral position; naturally, these displacements towards the right or towards the left are intended by reference to the representation of FIGS. 3 to 9, as well as to that of FIG. 2, and are indicated without any limitative intention, to the end of facilitating comprehension of the relative positionings of the different elements of the distributor according to the invention described by way of non-limitative example; the neutral position of the slide 67 is illustrated in FIGS. 3,8 and 9; the limit position of the slide 67 sliding towards the right with respect to the body 25 is illustrated in FIG. 6, intermediary positions are illustrated in FIGS. 4 and 5, and its extreme position in sliding towards the left is illustrated in FIG. 7.

Between its two ends 68 and 69, and more precisely between its articulation zone on the lever 11 about the axis 71 and between the shoulder 77, the slide 67 has the form of a circularly cylindrical rod about the axis 45, with a substantially identical diameter D, in which has been hollowed annular grooves about this axis 45, respectively 79,80,81, succeeding each other in this order from left to right, following the direction of the axis 45.

If one refers to the neutral position illustrated in FIG. 3, the slide 67 has from left to right, from the shoulder 77 of its end 69 to the zone of articulation on on the lever 11 about the axis 71 of its end 68:

a zone 83 circularly cylindrical about the axis 45 with a diameter substantially equal to the diameter D, this zone 83 being in peripherally fluid-tight contact with the bore 44 between the face 73 and the duct 34, between the duct 34 and the groove 96, between the groove 96 and the groove 46 whatever position the slide 67 occupies, by sliding in the bore 44, between its extreme left position and its extreme right position defined above, as well as when it occupies one or other of these extreme positions; this zone 83 is equally in fluid-tight contact with the bore 44 between the grooves 46 and 63, bridging the groove 46 and possibly a part of the groove 63 since, on acting on the lever 11, one displaces the slide 67 towards the right in the groove 44, that is to say into the extreme right position of the slide 67 as well as in the intermediary positions, except those intermediary positions immediately close to the neutral position; when the slide 67 occupies its extreme left position, as well as any position of the slide 67 intermediate between this position and the neutral position, the part 83 of the slide 67 preserves a fluid-tight contact with the bore 44 between the duct 34 and the groove 96 as well as between the grooves 96 and 46;

the groove 79, bridging the grooves 46 and 63 in the neutral position illustrated in FIGS. 2 and 3 as well as in the extreme left position of the slide 67 and in all intermediary positions between this extreme left position and the neutral position, as well as in the positions of the slide 67 immediately close to the neutral position when the slide 67 is displaced towards the right; on the contrary, this groove 79 bridges only the groove 63, as well as a part of the bore 44 between this groove 63 and the groove 43, in all other intermediary positions of the slide 67 towards its extreme right position, and in this extreme right position;

a zone 84 circularly cylindrical about the axis 45 with the diameter D, in fluid-tight contact with the bore 44 between the grooves 63 and 43 whatever the position of the slide 67 in the bore 44, from the extreme right position to the extreme left position;

the groove 80, bridging the groove 43 in the neutral position illustrated in FIG. 3, and bridging the grooves 43 and 66 in the extreme right position illustrated in FIG. 6 as well as in the intermediary positions closest to this extreme right position; the groove 80 is placed opposite the bore 44 between the grooves 43 and 63 in the extreme left position of the slide 67 as well as in the intermediary positions closest to this extreme position;

a zone 85 circularly cylindrical about the axis 45 with the diameter D, this zone 85 being in fluid-tight contact with the bore 44 between the groove 66 and the groove 43, on the one hand, and between the groove 66 and the groove 81, on the other hand, when the slide 67 occupies the neutral position illustrated in FIG. 3, bridging the groove 66; this zone 85 remaining in fluid-tight contact with the bore 44 between the grooves 65 and 66 for any position of the slide 67 displaced towards the right with respect to the neutral position, and in fluid-tight contact with the bore 44 between the grooves 43 and 66 for any position of the slide 67 displaced towards the left with respect to the neutral position;

the groove 81, placed opposite the groove 65 in the neutral position of the slide, this groove 81 being placed opposite the grooves 65 and 66 bridging the zone of the bore 44 intermediary between these two grooves 65 and 66 when the slide occupies its extreme left position so that in the intermediary positions between the neutral position and this extreme left position the nearest to this latter;

a zone 86 circularly cylindrical about the axis 45 with the diameter D, this zone 86 being in fluid-tight contact with the bore 44 between the groove 81 and the extreme right of the body 25 whatever the position of the slide 67 with respect to this latter, from the extreme right position to the extreme left position.

In addition, in the zone 85 are hollowed, at the junction of this with the grooves 80 and 81, progressivity grooves such as 93 and 94 respectively, positioned opposite the bore 44, which closes them respectively between the groove 66 and the groove 43 and between the groove 66 and the groove 81 when the slide 67 occupies the neutral position illustrated in FIG. 3, the progressivity grooves 93 becoming progressively opposite the groove 66 progressively as one displaces the slide 67 towards the right from the neutral position, for progressively putting the grooves 80 and 66 in communication, then the progressivity grooves 94 come progressively opposite the groove 66 when one displaces the slide 67 towards the left from the neutral position, for progressively putting in communication the grooves 81 and 66; such progressivity grooves are known in themselves to the man of the art, and do not require further description.

The different zones of the slide 67 which have been described are also shown schematically in FIG. 2.

In addition to this alternance of zones of diameter D and of grooves, the slide 67 has internally a longitudinal bore 95, on the axis 45.

When, as is shown, the slide 67 is formed by a rigid assembly of two pieces, that is to say a rod 97 extending from its end 68 of articulation on the lever 11 about the axis 71 as far as the shoulder 77 and a bolt 98 screwed on the axis 45 into the rod 97, for defining the second end 69 of the slide and, at this end 69, the end head 75 and the zone of the slide 67 which is situated between this head 75 and the shoulder 77 for permitting relative sliding of the cupped washers 74 and 78, the bore 95 is advantageously extended towards the left if one refers to FIGS. 3 to 9, to a transverse level, with reference to the axis 45, corresponding to that of the shoulder 77 inside which it opens from the rod 97, as far as a level, transverse to the axis 45, corresponding to that of the groove 79 and to which it is closed by a transverse end face 99, for example circularly conical about the axis 45; from this transverse end face 99 to its opening inside the shoulder 77, the bore 95 is delimited by an internal peripheral surface of the rod 97, which peripheral internal surface has a first section 100 circularly cylindrical about the axis 45 with a diameter less than the minimum diameter of the groove 79, from the face 99 to a level, transversely with respect to the axis 45, intermediary between the respective levels of the grooves 96 and 34 with reference to this axis when the slide 67 occupies the neutral position illustrated in FIG. 3 then this limit level of the first section 100 of the external peripheral surface of the bore 95 corresponds with that of the groove 96 in the extreme right position illustrated in FIG. 6, and with that of the groove 34 in the extreme left position illustrated in FIG. 7; above this limit level of the first section 100 in the direction of extension with respect to the face 99, on the axis 45, the internal peripheral surface of the bore 95 is defined by a second section 101 also circularly cylindrical about the axis 45, with a diameter intermediary between that of the section 100 and the maximum diameter D of the slide 67 (of the rod 97); the two sections 100 and 101 are connected between them by a shoulder 102, plane and annular, about the axis 45 to which it is perpendicular and which at the same time defines the extreme left limit of the first section 100 and the extreme right limit of the second section 101; this latter is continued towards the opening of the bore 95 from the rod 97, at the level of the shoulder 77 transversely with respect to the axis 45, and presents close to this opening a threaded zone 103 in which is screwed, providing a fluid-tightness assured by means known to the man in the art, the bolt 98 and more precisely a threaded rod 104 of it; this threaded rod 104 is connected, by a plane, annular shoulder 105, perpendicular to the axis 45 and abutting against the shoulder 77 at the junction of this latter with the opening of the bore 95, at a circularly cylindrical about the axis 45 surface 106 and facing in the direction of radial extension with respect to this latter, with a diameter intermediary between the maximum diameter of the threaded zone 103 and the diameter D, this surface 106 defining the sliding zone of the cupped washers 74 and 78 on the slide 67; in the direction of extension with respect to the shoulder 105, this surface 106 is itself delimited by a plane, annular shoulder 107 about the axis 45, to which it is perpendicular, this shoulder 107 being defined by the head 75 and facing towards the shoulder 107 for constituting for the cupped washer 74 the abutment towards the left, with respect to the slide 67, described above.

Inside the bore 95, the threaded rod 104 of the bolt 98 is delimited by a plane, annular face 108 about the axis 45 to which it is perpendicular, and by a pip 109 forming with respect to this face 108 a projection, on the axis 45, inside the bore 95; the face 108 and the central pip 109 of it defining by convention the left transverse end of the bore 95, of which the face 99 defines the right transverse end, if one refers to the positions illustrated in the Figures.

Between the shoulder 102 of the internal peripheral surface of the bore 95 and the transverse end of this latter defined with respect to the face 108 and the pip 109, a level corresponding with that of the intersection of the bore 44 with the duct 34 whatever the positions the slide 67 can occupy from the extreme right position to the extreme left position, opens into the section 101 of the internal peripheral surface of the bore 95 a passage 110 arranged radially, with reference to the axis 45, in the rod 97 and opening in addition into the section 83 of the slide 67.

Similarly, in the section 100 of the internal peripheral surface of the bore 95 open via respective orifices four passages 111,112,113,114 arranged radially, with reference to the axis 45, in the rod 97 and opening in addition via respective orifices into the section 83 of the rod 67; of these passages 111,112,113,114, the passage 114 is that which opens closest to the end face 99 of the bore 95 in the section 100 of the internal peripheral surface of this bore, being always spaced with respect to the end face 99; with reference to the axis 45, it is arranged at a transverse level corresponding to that of the groove 46 when the slide occupies the neutral position illustrated in FIG. 3 as well as in the extreme left position of the slide illustrated in FIG. 7 and in any intermediate position between the neutral position and the extreme left position; in the extreme right position of the slide, illustrated in FIG. 6, as well as in the intermediary positions of its passage from the neutral position to the extreme right position which are closest to this extreme right position, this passage 114 is situated at a level corresponding to that of the zone of the bore 44 separating the grooves 46 and 63 so that it is closed by the bore 44.

The passages 111,112,113 are themselves situated at respective levels succeeding each other in this order, along the length of the axis 45, from the level of the passage 114 to that of the shoulder 102 for connection between the sections 100 and 101 of the internal peripheral surface of the bore 95; in the neutral position of the slide illustrated in FIG. 3, their respective levels correspond with that of the groove 96; in the extreme right position of the slide, illustrated in FIG. 6, the levels of the passages 111, 112,113 coincide respectively with that of the groove 46, that of the zone of the bore 44 intermediary between the grooves 46 and 96, and that of the groove 96; in the extreme left position of the slide, illustrated in FIG. 7, the levels of the passages 111,112,113 coincide respectively with that of the groove 96, that of the zone of the bore 44 intermediary between the groove 96 and the intersection of the bore 44 with the duct 34, and that of this intersection of the bore 44 with the duct 34.

Inside the bore 95 is mounted, slidingly on the axis 45 with respect to the slide 67, a piston 115 having an external, peripheral, circularly cylindrical about the axis 45, surface 116 with a diameter substantially the same as that of the first section 100 of the internal peripheral surface of the bore 95, in a manner to establish a mutually sliding and fluid-tight contact between the surfaces 100 and 116; towards the face 99 of the bore 95, the surface 116 is delimited by a junction with a transverse end face 117 of the piston 115, which face 117 is plane and perpendicular to the axis 45; in the direction of extension with respect to the end face 99 of the bore 95 on the axis 45, that is to say towards the face 108 and its pip 109, the surface 116 is delimited by junction with a plane, annular about the axis 45 to which it is perpendicular, face 118, this face 118 having a pip 119 projecting on the axis 45 towards the pip 109, of which this pip 119 constitutes a mirror image with respect to a virtual plane, not shown, perpendicular to the axis 45; the distance separating the faces 117 and 118 of the piston 115 parallel to the axis 45 is intermediary between the distances separating respectively the annular shoulder 102 of the internal peripheral surface of the bore 95, the end face 99 of this and the passage 114, in the opening zone of this latter in the bore 95 the nearer the face 99 of this latter, so that the piston 115 can particularly occupy, inside the bore 95, a position which is illustrated in FIG. 3 and in which its face 118 is coplanar with the shoulder 102 and its face 117 is placed opposite the face 99 but a distance from this, in the direction of the axis 45, for delimiting with this face 99, as with a part of the first section 100 of the internal peripheral surface of the bore 95, a fluid-tight chamber 219; this position of the slide 115 inside the bore 95 constitutes a stable rest position, from which the slide can be displaced towards the left, that is to say in a direction of extension of its face 117 with respect to the face 99 of the bore 95, with a compression of a helical spring 220, on the axis 45, interposed between the face 108, about the pip 109, and an intermediary washer 221 for abutment on the face 118, about the pip 119; when from such a displacement of the piston, the spring 220 tends to return it to the initial position illustrated in FIG. 3; in this initial position, the abutment washer 221 for the spring 220 on the face 118 of the piston 115 is also abutted against the shoulder 102, which then interrupts urging of the piston 115 towards the face 99 of the bore 95 under the action of the spring 220, a continuance of the movement of the piston 115 towards the face 99 being excluded, when the distributor is in service, by the presence of fluid under pressure in the chamber 219 as will appear below.

In its external peripheral surface 116, the piston 115 has in the illustrated example two grooves 120 and 121, annular about the axis 45, disposed respectively nearer the face 117 and nearer the face 118, and in each of these grooves 120 and 121 opens a passage 122 arranged inside the piston 115, substantially on the axis 45, and opening in addition in the face 117 of the piston 115, that is to say in the chamber 219 with which it thus puts into communication the two grooves 120 and 121.

If one refers to the initial position of the piston 115 illustrated in FIG. 3, the grooves 120 and 121 are arranged such that the groove 120 is placed opposite the passage 114 in this initial position, and the groove 121 is then positioned opposite the passages 111 and 112; in this initial position of the piston 115 as also in all positions of this latter which will be explained below, the passage 110 opens freely, that is to say without being closed by the piston 115, to the interior of the second section 101 of the internal peripheral surface of the bore 95 of which the end corresponding to the face 108 and to the pip 109 thus remains permanently open towards the duct 34.

If, from the initial position illustrated in FIG. 3, the piston 115 is displaced progressively towards the left as far as an extreme left position, with respect to the bore 95, or a safety position illustrated in FIG. 8, it passes successively through intermediary positions, in which, respectively:

the groove 120 is placed substantially opposite the first section 100 of the internal peripheral surface of the bore 95 between the respective levels of the passage 114 and of the passage 111, and for a lesser part opposite the passage 114 (an intermediary position illustrated in FIG. 4) then also opposite the first section 100 of the internal peripheral surface of the bore 95 between the respective levels of the passages 114 and 111 (a non-illustrated position), then the groove 121 continues to be placed opposite the passages 111 and 112, the groove 120 is placed opposite a first section 100 of the internal peripheral surface of the bore 95 between the respective levels of the passages 114 and 111 then the groove 121 is placed opposite the passages 112 and 113 and, for a lesser part, opposite the passage 111 (the position illustrated in FIG. 5 and in FIG. 6), the groove 120 is placed opposite the first section 100 of the internal peripheral surface of the bore 95 between the respective levels of the passages 114 and 111, and the groove 121 is placed opposite the passages 112 and 113 as well as opposite the second section 101 of the internal peripheral surface of the bore 95, bridging the shoulder 102 of it (a safety position, or extreme left position of the piston 115 inside the bore 95, illustrated in FIG. 8).

The arrangements which have been described lead to the following functioning of the distributor 12, considered integrated with the first distribution section of a compound distributor of the type illustrated in FIG. 2 where the piston 15 appears in the form of a slide distributor, the spring 220, as well as the passages 111,112,113 and 114 in their different functions which will appear presently; each of these passages performs different functions according to the condition of the distributor, the corresponding references will appear several times on FIG. 2.

The distributor 12 being connected in a manner described with reference to FIG. 2, particularly indirectly to the ducts 13 and 15, and directly to the ducts 14 and 16 as well as to the ducts 37,59,49 of the second distribution section 18 and, by the intermediary of these, to the ducts 52 and 40 of the end section 19, the initial state illustrated in FIG. 3 will be envisaged, in which the slide 67 occupies its neutral position inside the bore 44, under the action of the spring 70, and the piston 115 occupies its initial position described above inside the bore 95.

Then, the groove 79 of the slide ensures a communication between the grooves 46 and 63, which permits ensuring, across the distributor 12, the feed from the second distribution section 18 on the one hand via the ducts 24 and 62 and on the other hand via the duct 29; on the contrary, the section 85 of the slide 67 isolates the groove 66 both with respect to the groove 43 and the groove 65, and the jack 10 can neither receive hydraulic fluid from the pump 4, nor discharge towards the reservoir 5 so that it is immobile in a position determined by the preceding action of the distributor; the slide 57 of the second distribution section 18 occupying also a neutral position, that is to say corresponding to one of immobility of the jack controlling the tilting 6 of the mast in ensuring a connection between the ducts 59 and 55 and, via their intermediary, with the ducts 52, 49,34,30,15 in return towards the reservoir 5, the pump 4 is not driven, and can be stopped or simply used in a condition of circulation of hydraulic fluid from the reservoir 5 and in return towards the reservoir 5, substantially at the low pressure of this reservoir; this low pressure is also present in the chamber 219, in communication with the groove 46 in the passage 114 of the slide 67, the groove 120 of the piston 115 and the passage 122 of it, and this low pressure is also present in the groove 96 and the duct 88 leading to the connection duct 16 with the servo-motor 2, because the connection ensured by the passage 122 between the chamber 219 and the groove 121, itself placed opposite the passages 111 and 112 then leading into the groove 96; the servo-motor 2 receives as a result then a pressure signal of a value substantially corresponding to that of the pressure of the reservoir 5.

If one displaces the slide 67 from the neutral position, corresponding to the initial condition, towards the right, in order to put into communication the grooves 43 and 66 via the groove 80, that is to say to feed the jack 10 with hydraulic fluid from the duct 29 and, via it, from the pump 4, the section 83 of the slide 67 progressively closes the connection between the grooves 63 and 46, which results in an increase in pressure in the ducts 24 and 29, that is to say in the grooves 43 and 46; this increase in pressure in the groove 46 is transferred, via the passage 114, the groove 120 and the passage 122, via an increase of pressure in the chamber 219, which creates a force tending to push the piston 115 towards the left inside the bore 95 of the slide 67, that is to say to close the connection between the groove 120 and the duct 114, then the spring 220 is opposed to such a closing; one thus leads to a position illustrated in FIG. 4, in which the connection between the grooves 63 and 46 is closed whilst the connection between the grooves 43 and 66 is not opened again, and in which the piston 115 occupies inside the bore 95 of the slide 67 a position of equilibrium, in which the fluid passage cross-section of the passage 114 towards the groove 120 is sufficiently reduced for bringing about a reduction of pressure from the groove 46 to the chamber 219, and to thus establish in this latter a pressure, reduced with respect to that present in the groove 46, and producing on the piston 115 a force balancing that which opposes the return spring 220.

An appropriate calibration of the spring 220 permits adjustment of the threshold of pressure, in the chamber 46, leading to the passage of the piston 115 to such a position of equilibrium, to a value greater than a maximum value of hydraulic pressure in the grooves 46 and 43, that is to say in the ducts 24 and 29, when the slide 67 occupies the neutral position and the ducts 24 and 29 are connected to the source 4 when the duct 34 and the duct 62 (via the intermediary of the second distribution section 18 and of the end section 19) are connected to the reservoir 5, this threshold being also chosen below a minimum value of hydraulic pressure in the ducts 24 and 29, that is to say in the grooves 46 and 43, when the slide 67 occupies an active condition placing in communication the grooves 43 and 66 via the groove 80, as will be described below, when the ducts 24 and 29 on the one hand, and the ducts 87 on the other hand are connected respectively to the source 4 and to the jack 10.

The pressure thus appearing in the chamber 219 is transmitted, via the passage 122, the groove 121, and the passages 111 and 112, to the groove 96 and from there to the duct 88, that is to say to the servo-motor 2 which then acts on the thermodynamic motor 3 for adjusting the flow rate of the pump to a new minimum level, greater than the possible flow rate corresponding to the initial condition described with reference to FIG. 3.

The value of hydraulic pressure thus obtained in the duct 88 represents a first level of this pilot pressure of the hydraulic servo-motor 2.

FIG. 9 shows that this first level of pilot pressure in the duct 88 is also obtained when the slide 67 occupies its neutral position, illustrated in FIG. 3 and described with reference to it, but the slide 67 of the distributor 18 constituting the distribution second section is placed in a position for interrupting the connection between the ducts 59 and 55, that is to say for interrupting the connection between the duct 62 (groove 63) of the distributor 12 and the reservoir 5; such an interruption brings about in effect in the grooves 43 and 46 an increase in pressure analogous to that which has been described with reference to FIG. 4, and, the chamber 219 being then connected respectively to grooves 46 and 96 in the same way as in the case described with reference to FIG. 4, the slide 115 is displaced into a position of identical equilibrium to that which has been described with reference to FIG. 4, inside the bore 95 of the slide 67.

Figure 10:
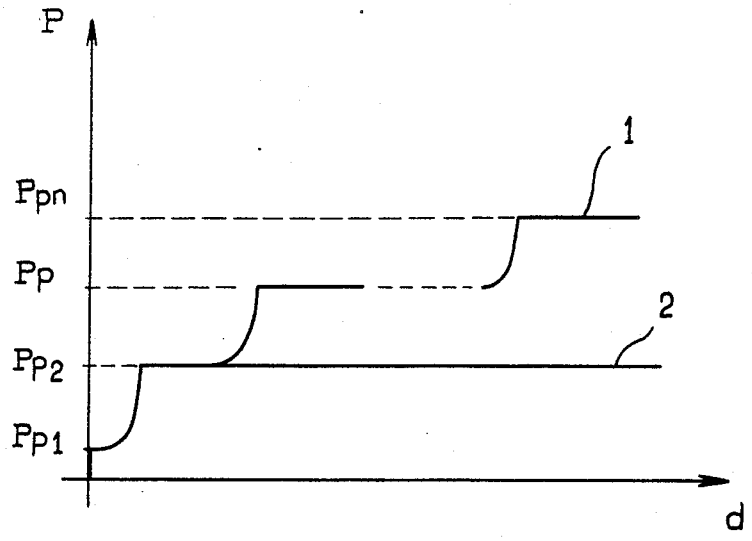
FIG. 10 shows a representative diagram of the pilot pressure as a function of displacement of the distributor of the first or greater distribution sections in the case of an integrated distributor according to the invention.

In the case of a distributor having several distribution sections, as has already been mentioned in connection with the description of FIG. 2, the second level of pilot pressure Pp2 can equally be, as shown in FIG. 10, obtained by action of one and/or the other of the slides 67 of the distributors constituting the higher sections of a bank of distributors such as shown in FIG. 2, the first distributor, or the distribution first section having its slide 67 maintained in a neutral position. In FIG. 10, it is shown that the level of pressure Pp2 is constant, reference curve 2, as a function of the position d of the slides of the higher distribution sections. In the case of simultaneous action on one or several of the slides of the higher distribution sections and of the slide 67 of the first distribution section the level of pressure obtained for the pilot pressure in the duct 88 is that of the single first distribution section of which the action is preponderant, reference curve 1. Thus, it is also possible to obtain, from the modulation means 111, 112,113,114 for controlling the hydraulic pilot pressure the said first predetermined value Pp1 when the distribution means or the slide 67 occupy the passive condition, the said second predetermined value Pp2 different from the first when one or several of the slides 67 of the second distribution sections are activated, the slide of the first distribution section being in neutral position.

If, from the condition illustrated in FIG. 4, one continues the displacement of the slide 67 towards the right inside the bore 44, the reduced pressure with respect to that present in the groove 46, being present in the chamber 219 and in the duct 88 remains constant, the slide 115 remaining unmoved with respect to the slide 67 inside the groove 95, then the progressivity grooves 93, as well as the groove 80, progressively establish a communication between the grooves 43 and 66 for feeding the jack 10 with hydraulic fluid from the source 4; always, since, in the course of this movement of the slide 67, the passage 111 is presented opposite the groove 46, which permits introduction into the chamber 219, via the passage 111, via the groove 121 and via the passage 122 of the piston 115, of fluid coming from the groove 46, and which breaks the equilibrium of the slide 115 between the force which it receives from the pressure present in ther chamber 219 and that which it receives from the spring 220, the piston 115 is displaced again towards the left, inside the bore 95 of the slide 67, for tending to close the connection thus created between the comparatively high pressure in the passage 111 and the comparatively low pressure in the chamber 219, and for gaining again a new position of equilibrium illustrated in FIG. 5, which is obtained when the pressure present in the chamber 219, reduced with respect to the pressure present in the groove 46, applies to the piston 115 an equal force opposed to the force applied to the piston 115 via the spring 220; insofar as, in this position, the spring 220 is compressed more than before, that is to say in the condition illustrated in FIG. 4, the pressure then present in the chamber 210 has a value greater than that which it had in the position of equilibrium described with reference to FIG. 4 and this pressure is transmitted, via the passage 122 and the groove 121 of the piston 115, and via the ducts 112 and 113 to the groove 96, that is to say to the groove 88 in which thus appears a pilot pressure at a second level.

This pilot pressure of a second level, fed to the servomotor via the duct 16, is used for increasing the condition of the drive motor 3 of the pump 4 for increasing the flow rate of it.

In the position illustrated in FIG. 5, a connection is already established via the groove 80 between the grooves 43 and 66, when any connection remains interrupted between the grooves 63 and 46, on the one hand, 63 and 43, on the other hand, and between the grooves 66 and 81.

FIG. 6 illustrates the extreme right position of the slide 67 in the bore 44 and shows that, from the intermediary position illustrated in FIG. 5 to this extreme position illustrated in FIG. 6, the feed conditions of the chamber 219 with fluid coming from the groove 46 remain unchanged when a communication remains established between the chamber 219 and the groove 96 via the passage 113, so that the slide 115 preserves, inside the bore 95 of the slide 67, the position of equilibrium described for FIG. 6 and which the distributor emits to a level of the duct 88 a hydraulic pressure of the second mentioned level.

It should be noted that one can provide between the respective levels of the passage 111 and of the passage 112, along the length of the axis 45, other passages arranged radially, with reference to the axis 45, in the slide 67 for connecting the section 83 of this latter to the section 100 of its bore 95; the successive appearance, opposite the groove 46, of orifices corresponding to these supplementary passages respectively further and further from the passage towards the left, when the prgression of the slide 67 from the position illustrated in FIG. 5 to the position illustrated in FIG. 6, will bring about successive passages of the piston 115, inside the bore 95, to positions of successive equilibrium respectively further from the face 99 via the process described with reference to passages 114 and 111, this will lead to the emission, in the duct 88, of pilot pressures having respectively lower values than the pressure present in the groove 46, but respectively progressively larger and larger in steps of which the groove 80 will permit the passage of a larger and larger flow rate, varying itself continuously, from the groove 43 to the groove 66; a determined level of pressure will be preserved, progressively from this displacement of the slide 67 towards the right, as far as the emission of a pilot pressure of the immediately larger level.

By way of non-limitative example, there has thus been shown between the passages 111 and 112 a supplementary passage 123, spaced with respect to the passage 111 not only towards the left but also angularly with reference to the axis 45, so that the supplementary passages can be multiplied at will for bringing about any number of desired levels of pilot pressure (see FIG. 3); in a general manner, the difference of value between the two levels of pressure appearing successively, on a displacement of the slide 67 towards the right, will then function to space, along the axis 45, between the two passages such as 111 and 123 appearing successively opposite the groove 46 on such a movement in the case of passages associated with the same groove 121 of the piston 115; in the case of such passages, the passages 111 and 114, associated with two different grooves 120 and 121 of the piston 115, the difference between the levels of pilot pressure respectively associated with the two passages as a function of their relative spacing along the axis 45, and of the relative spacing of the dimensions of the grooves 120 and 121; the determination of the most appropriate sides is within the normal ability of the man skilled in the art, as is the choice of a solution using a single groove on the piston 115 or a solution using several grooves on this piston.

The conditions of the distributor 12 illustrated in FIGS. 5 and 6 correspond to the active conditions insofar as the distributor 12 leads fluid from the source 4 towards the jack 10.

These active conditions necessitate that the source 4 provides a sufficient flow of fluid, taking account of the volume of the chamber (not shown) of the jack 10.

In addition to these active conditions and the passive condition which constitutes the neutral position illustrated in FIG. 3, the distributor 12 can also occupy several other passive conditions corresponding to a displacement of the slide 67 towards the left inside the bore 44, until the slide 67 attains an extreme left position illustrated in FIG. 7.

In this extreme left position as in any intermediary position between it and the neutral position, the passage 114 remains positioned opposite the groove 46, so that the piston 115 occupies its initial position illustrated in FIG. 3 if the second distribution section 18, or several sections replacing it, permits a free passage from the duct 62 to the duct 52, or the position illustrated in FIG. 9 if the distribution section 18 or one of the sections replacing it interrupts this connection.

Whatever the position occupied by the slide 67, and particularly, when the pilot pressure appearing in the duct 88 is utilised for controlling, by way of the servomotor 2, a jack adjusting the condition of the thermodynamic motor 3, it is possible that counter pressures increase the pressure in the passage 88, and in consequence in the chamber 219, because of the effects external to the system which constitutes the distributor 12 which has been described; whatever the position of equilibrium then occupied by the piston 115, the increase of pressure in the chamber 219 returns the piston 115 towards the left inside the bore 95, which can lead to damage of the device, and even danger.

Consequently there is provided, in the example of the embodiment of the device according to the invention which has been described and shown, a safety system in the form of a possibility of intercommunication between the duct 88 and the intersection of the duct 34 with the bore 44, when the piston 115 attains, by sliding towards the left inside the bore 95, a position further extended from the face 99 of the bore 95 than its position corresponding to the different levels of pilot pressure.

For this, if the pressure in the duct 88 exceeds a predetermined threshold, above these levels of pressure, this pressure transmits to the chamber 219 by means of one of the passages 111,112,113, positioned opposite the groove 96 as a function of the position of the slide 67 in the bore 44, bringing about a displacement of the piston 115 towards the left inside the bore 95 as far as the groove 121, bridging the shoulder 102 of the internal peripheral surface of the bore 95, putting into communication at least the passage 113, and also the passage 112 in the example illustrated in FIG. 8, with the space then existing between the external peripheral surface 116 of the piston 15 and the section 101, of greater diameter, of the bore 95, that is to say with the assembly of the end zone of this communicating via the passage 110 with the intersection of the duct 34 and of the bore 44; the counter-pressure thus appears in the duct 88, passing the predetermined threshold by the level of compression of the spring 220 when the groove 121 begins to bridge the shoulder 102 of the internal peripheral surface of the bore 95, is thus evacuated towards the reservior 5 and the piston 115 can regain its normal equilibrium position, exclusively dicated by the position of the slide 67 and the level of pressure in the groove 46, when the counter-pressure ceases.

Naturally, the embodiment of a distributor according to the invention which has been described constitutes only a preferred example, and the man skilled in the art will provide numerous variations of this distributor without departing from the scope of the present invention.

We claim:

1. In a hydraulic distributor of the type comprising at least one inlet duct able to be connected to a source of hydraulic fluid under high pressure, at least one principal outlet duct able to be connected to utilisation means of hydraulic fluid under high pressure, at least one return duct able to be connected to a reservoir of hydraulic fluid under low pressure, and distributor means able to occupy several conditions in which it establishes or interrupts hydraulic connections between certain of said ducts, and in particular at least one passive condition in which said distributor means establishes a hydraulic connection between said inlet duct and said return duct interrupting any hydraulic connection between said inlet duct and said principal outlet duct, and at least one active condition in which said distributor means establishes a hydraulic connection between said inlet duct and said principal outlet duct interrupting any hydraulic connection between said inlet duct and said return duct, the improvement comprising:

an auxiliary outlet duct;

pressure reducing means, sensitive to the hydraulic pressure in said inlet duct, for establishing a hydraulic connection between said inlet duct and said auxiliary outlet duct:

when the value of the hydraulic pressure in said inlet duct exceeds a predetermined threshold, and then causes the appearance, in said auxiliary outlet duct, of a hydraulic pilot pressure of a reduced value with respect to the value of hydraulic pressure in said inlet duct, when the value of the hydraulic pressure in said inlet duct is below the said threshold, and to transmit this pressure to said auxiliary outlet, the said threshold being on the one hand greater than a maximum value of hydraulic pressure in said inlet duct when said distributor means occupies a passive condition and said inlet duct and said return duct are respectively connected to the source and to the reservoir, and on the other hand lower than a minimum value of hydraulic pressure in said inlet duct when said distributor means occupies an active condition and said inlet duct and said principal outlet duct are respectively connected to the source and to the utilisation means; and modulation means, coupled to said distributor means, for modulating the value of the hydraulic pilot pressure in a predetermined manner, as a function of the condition of said distributor means.

2. A hydraulic distributor according to claim 1, wherein said modulation means are able to give the hydraulic pilot pressure a first predetermined value when said distributor means occupies a passive condition, and at least a second predetermined value, different from the first, when said distributor means occupies an active condition.

3. A hydraulic distributor according to claim 2, wherein the second value is greater than the first.

4. A hydraulic distributor according to claim 1, said distributor means being able to occupy a plurality of active conditions in which it establishes a hydraulic connection between said inlet duct and said principal outlet duct, permitting respective different flow rates from said inlet duct towards said principal outlet duct, interrupting any hydraulic connection between said inlet duct and said outlet duct, wherein said modulation means are able to give to the hydraulic pilot pressure a first predetermined value when said distributor means occupies a passive condition, and a plurality of respective second predetermined values, different from the first and different from each other, when said distributor means occupies the different active conditions.

5. A hydraulic distributor according to claim 4, wherein the said second values are greater than the first value, and increase or decrease respectively, according to whether the flow rate permitted by said distributor means increases or decreases.

6. A hydraulic distributor according to claim 4, the said active conditions being accessible in continuous succession, permitting the flow rate to vary continuously, wherein said modulation means give the said second values progressively.

7. A hydraulic distributor according to claim 1, comprising safety means, for:

automatically establishing a connection between said auxiliary outlet duct and said return duct if the value of hydraulic pressure in said auxiliary outlet duct exceeds another predetermined threshold greater than the said values of pilot pressure, interrupting automatically any connection between said auxiliary outlet duct and said return duct if the value of hydraulic pressure in said auxiliary outlet duct is below that of this other predetermined threshold.

8. A hydraulic distributor according to claim 1, combined with means, in hydraulic connection with said auxiliary outlet duct, for piloting the flow rate of the hydraulic fluid from said source as a function of the value of the hydraulic pilot pressure.

9. An integrated hydraulic distributor, comprising a plurality of distribution sections of which the first at least is constituted by a hydraulic distributor according to claim 1, in which the second predetermined value of pilot pressure differing from the first is obtained when a slide of a higher distribution section is actuated, the slide of the first distribution section being in neutral position.

10. In a hydraulic distributor of the type comprising at least one inlet duct able to be connected to a source of hydraulic fluid under high pressure, at least one principal outlet duct able to be connected to utilisation means of hydraulic fluid under high pressure, at least one return duct able to be connected to a reservoir of hydraulic fluid under low pressure, and distributor means able to occupy several conditions in which it establishes or interrupts hydraulic connections between certain of said ducts, and in particular at least one passive condition in which said distributor means establishes a hydraulic connection between said inlet duct and said return duct interrupting any hydraulic connection between said inlet duct and said principal outlet duct, and at least one active condition in which said distributor means establishes a hydraulic connection between said inlet duct and said principal outlet duct interrupting any hydraulic connection between said inlet duct and said return duct, the improvement comprising:

an auxiliary outlet duct;

a bore having an internal peripheral surface defining a longitudinal direction, a first transverse end and a second transverse end, means for hydraulic connection of said first end with said auxiliary outlet duct, means for hydraulic connection of said second end, with said return duct, at least two orifices arranged in said internal peripheral surface, with a first said orifice comparatively close to said first end and at least one second said orifice comparatively further from said first end, a piston mounted for longitudinal sliding inside said bore and having an external peripheral surface in sliding and fluid-tight contact with said internal peripheral surface of said bore, a transverse face of a first transverse end opposite said first transverse end of said bore, a second transverse end opposite said second end of said bore, a compression spring acting between said second ends for resiliently urging said piston in said bore, towards said first end of this latter, a passage, arranged in said piston, opening on the one hand in said face of said first transverse end of said piston and on the other hand in said external peripheral surface of said piston, opposite said orifices of said internal peripheral surface of said bore, auxiliary distributor means, coupled to said principal distributor means, for establishing a hydraulic connection between said inlet duct and, alternatively, said first orifice or said second orifice according to, respectively, said principal distributor means occupying the passive condition or the active condition.

11. A hydraulic distributor according to claim 10, said principal distributor means being able to occupy a plurality of active conditions in which it establishes a hydraulic connection between said inlet duct and said principal outlet duct permitting respective different flow rates from said inlet duct towards said principal outlet duct, interrupting any hydraulic connection between said inlet duct and said return duct, wherein said internal peripheral face of said bore has a plurality of second orifices differently elongated from said first end of said bore; and said auxiliary distributor means coupled to said principal distributor means are able to establish a hydraulic connection between said inlet duct and, selectively, a respective one of said second orifices when said principal distributor means occupies the said active conditions, said second respective orifice being itself further from said first end of said bore so that the active condition occupied by said principal distributor means corresponds to a greater permitted flow rate.

12. A hydraulic distributor according to claim 10, comprising means for establishing automatically a hydraulic connection between said auxiliary outlet duct and said return duct if the hydraulic pressure in said auxiliary outlet duct exceeds another predetermined threshold, and for interrupting automatically any hydraulic connection between said auxiliary outlet duct and said return duct if the hydraulic pressure in said auxiliary outlet duct is less than this other predetermined threshold.

13. A hydraulic distributor according to claim 10, comprising means for automatically establishing a hydraulic connection between said passage of said piston and said second end of said bore if the hydraulic pressure at said first end of said bore exceeds another predetermined threshold, or for interrupting automatically any hydraulic connection between said passage of said piston and said second end of said bore if the hydraulic pressure at said first end of said bore is lower than this other predetermined threshold.

14. A hydraulic distributor according to claim 10, said principal distributor means comprising a slide movable inside a body of said distributor having said ducts for inlet, for principal outlet, for return, for auxiliary outlet, and means of actuation of said slide, wherein said auxiliary distributor means are constituted by said slide.

15. A hydraulic distributor according to claim 14, wherein said bore is situated inside said slide; and said auxiliary distributor means for establishing a hydraulic connection between said inlet duct and, alternatively, said first orifice or said second orifice said means for hydraulic connection from said first end of said bore with said auxiliary outlet duct and said means for hydraulic connection from said second end, of said bore with said return duct comprise passages in said slide.

* * * * *